US011261696B2

(12) United States Patent
Royer

(10) Patent No.: US 11,261,696 B2
(45) Date of Patent: Mar. 1, 2022

(54) SELECTIVE POSITION TOP-DOWN CEMENTING TOOL

(71) Applicant: Dril-Quip, Inc., Houston, TX (US)

(72) Inventor: Edward Shannon Royer, Missouri City, TX (US)

(73) Assignee: Dril-Quip, Inc., Houston, TX (US)

( * ) Notice: Subject to any disclaimer, the term of this patent is extended or adjusted under 35 U.S.C. 154(b) by 0 days.

(21) Appl. No.: 17/018,919

(22) Filed: Sep. 11, 2020

(65) Prior Publication Data

US 2021/0079757 A1 Mar. 18, 2021

Related U.S. Application Data

(60) Provisional application No. 62/901,873, filed on Sep. 18, 2019.

(51) Int. Cl.

| | |
|---|---|
| ***E21B 33/14*** | (2006.01) |
| ***E21B 34/14*** | (2006.01) |
| ***E21B 33/16*** | (2006.01) |

(52) U.S. Cl.

CPC ..... *E21B 33/146* (2013.01); *E21B 33/165* (2020.05); *E21B 34/142* (2020.05)

(58) Field of Classification Search

CPC ..... E21B 33/14; E21B 34/142; E21B 43/10
See application file for complete search history.

(56) References Cited

U.S. PATENT DOCUMENTS

| | | | | |
|---|---|---|---|---|
| 3,260,309 | A * | 7/1966 | Brown | E21B 33/14 166/124 |
| 5,404,945 | A * | 4/1995 | Head | E21B 21/08 166/155 |
| 5,960,881 | A * | 10/1999 | Allamon | E21B 21/103 166/285 |
| 7,318,478 | B2 | 1/2008 | Royer | |
| 7,954,555 | B2 * | 6/2011 | Ashy | E21B 21/103 166/386 |
| 2001/0045288 | A1 * | 11/2001 | Allamon | E21B 23/04 166/373 |

(Continued)

FOREIGN PATENT DOCUMENTS

WO 2018/009191 A1 1/2018

OTHER PUBLICATIONS

Search Report issued in related United Kingdom Patent Application No. GB2014586.8 dated May 19, 2021, 1 page.

(Continued)

*Primary Examiner* — Shane Bomar
(74) *Attorney, Agent, or Firm* — Baker Botts L.L.P.

(57) ABSTRACT

A cementing system and method for selectively providing bottom-up cementing and top-down cementing of a liner during a single downhole trip are provided. The cementing system has three configurations. A first configuration of the tool allows fluid flow through a central flowbore of the cementing tool, a liner hanger setting tool below the cementing tool, and the liner. A second configuration of the tool routes fluid from the central flowbore of the cementing tool to an annulus surrounding the liner hanger setting tool and the liner. A third configuration of the tool reestablishes flow through the central flowbore of the cementing tool and enables a dropped ball to reach the liner hanger setting tool.

19 Claims, 11 Drawing Sheets

(56) References Cited

U.S. PATENT DOCUMENTS

| | | | | |
|---|---|---|---|---|
| 2006/0272825 | A1* | 12/2006 | Royer | E21B 34/14 166/373 |
| 2007/0240883 | A1 | 10/2007 | Telfer | |
| 2007/0272411 | A1* | 11/2007 | Lopez De Cardenas | E21B 34/14 166/305.1 |
| 2016/0024876 | A1* | 1/2016 | Ward | E21B 43/105 166/285 |
| 2016/0024877 | A1* | 1/2016 | Coronado | E21B 33/16 166/177.4 |
| 2016/0160603 | A1 | 6/2016 | Sevadjian et al. | |
| 2019/0024476 | A1* | 1/2019 | Adam | E21B 33/14 |
| 2019/0024479 | A1* | 1/2019 | Bocangel Calderon | E21B 23/04 |
| 2021/0115757 | A1* | 4/2021 | Murray | E21B 23/01 |

OTHER PUBLICATIONS

Halliburton VersaFlex® Top-Down Squeeze Cementing Valve brochure, H012753, Jun. 2017, 2 pages.

* cited by examiner 430
430
204
430
206
429
414
302
300

422
800
446
430
421
202
200
420

102

SELECTIVE POSITION TOP-DOWN CEMENTING TOOL

CROSS-REFERENCE TO RELATED APPLICATION

The present application claims priority to and the benefit of U.S. Provisional Application Ser. No. 62/901,873, entitled "Selective Position Top-Down Cementing Tool," filed on Sep. 18, 2019.

TECHNICAL FIELD

The present disclosure relates generally to a cementing tool for use with a liner hanger and, more particularly, to a selective position top-down cementing tool for use with a liner hanger.

BACKGROUND

When drilling a well, a borehole is typically drilled from the earth's surface to a selected depth and a string of casing is suspended and then cemented in place within the borehole. A drill bit is then passed through the initial cased borehole and is used to drill a smaller diameter borehole to an even greater depth. A smaller diameter casing is then suspended and cemented in place within the new borehole. This is conventionally repeated until a plurality of concentric casings are suspended and cemented within the well to a depth which causes the well to extend through one or more hydrocarbon producing formations.

Rather than suspending a concentric casing from the bottom of the borehole to the surface, a liner is often suspended adjacent to the lower end of the previously suspended casing, or from a previously suspended and cemented liner, so as to extend the liner from the previously set casing or liner to the bottom of the new borehole. A liner is defined as casing that is not run to the surface. A liner hanger is used to suspend the liner within the lower end of the previously set casing or liner.

A running and setting tool disposed on the lower end of a work string may be releasably connected to the liner hanger, which is attached to the top of the liner. The work string lowers the liner hanger and liner into the open borehole until the liner reaches a desired location. Once the liner reaches the desired location, the liner may be cemented in the borehole and against the previous casing. Cement is typically pumped down the bore of the work string and liner and up the annulus formed by the liner and open borehole. As deeper wells are drilled and longer liners are utilized, cement is circulated through the liner assembly at higher pressures to reach the bottom of the liner and flow back up the annulus. When a liner is set within a borehole, the cement being pumped to secure the liner in place can potentially exceed the pore pressure of the formation through which the borehole extends. Low pore pressure or thief zones severely limit the pressure that may be applied while cementing such that it may not be possible to circulate cement up the entire backside height of the liner. This can inhibit the ability to properly and completely conduct a well cementing operation using traditional bottom-up cement circulation.

It is now recognized that a need exists for a liner cementing tool that can be selectively configured for traditional liner cementing or top-down liner cementing.

BRIEF DESCRIPTION OF THE DRAWINGS

For a more complete understanding of the present disclosure and its features and advantages, reference is now made to the following description, taken in conjunction with the accompanying drawings, in which.

DETAILED DESCRIPTION

Figure 1:
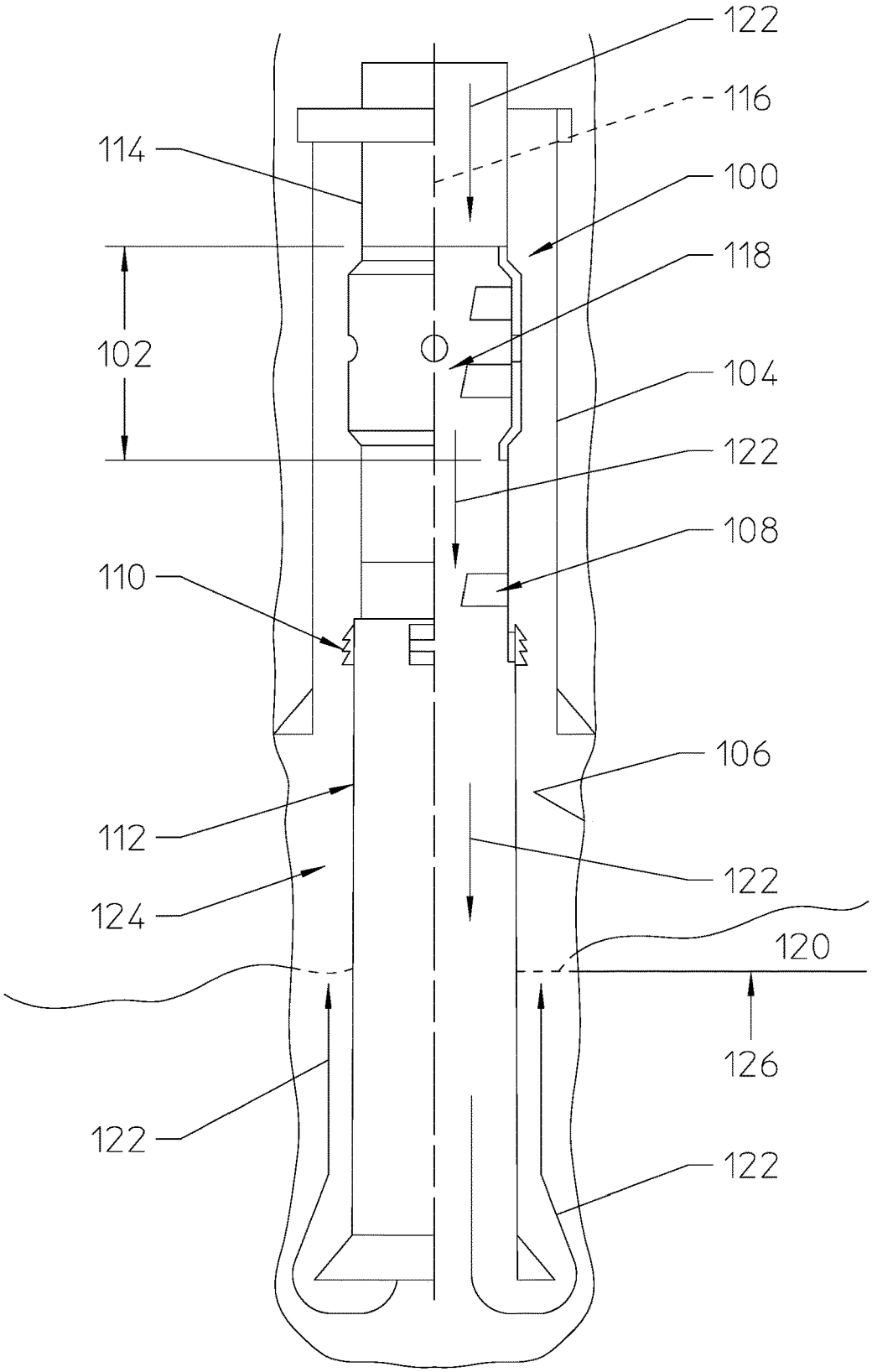
FIG. 1 is a schematic illustration of a liner installation work string including a liner hanger assembly coupled to a cementing tool being used to cement a liner in a well with low pore pressure, in accordance with an embodiment of the present disclosure.

Illustrative embodiments of the present disclosure are described in detail herein. In the interest of clarity, not all features of an actual implementation are described in this specification. It will of course be appreciated that in the development of any such actual embodiment, numerous implementation specific decisions must be made to achieve developers' specific goals, such as compliance with system related and business related constraints, which will vary from one implementation to another. Moreover, it will be appreciated that such a development effort might be complex and time consuming, but would nevertheless be a routine undertaking for those of ordinary skill in the art having the benefit of the present disclosure. Furthermore, in no way should the following examples be read to limit, or define, the scope of the disclosure.

Certain embodiments of the present disclosure may be directed to a cementing system and method for selectively providing bottom-up cementing and top-down cementing of a liner during a single downhole trip. The disclosed cementing system is an accessory tool designed to be used in conjunction with liner installations, and it is specifically designed to facilitate one-trip top-down cementing for wells formed through formations with low pore pressure (or expected low pore pressure).

The disclosed cementing tool includes a body with a first seat, a second seat, and a shifting sleeve assembly disposed internal to the body, and one or more ports extending through the body. The first seat is configured to receive a ball landed thereon, and the second seat is configured to receive a ball, dart, or plug landed thereon. The shifting sleeve assembly is configured to selectively transition the cementing tool from a first operating mode to a second operating and from the second operating to a third operating mode.

As such, the disclosed cementing system has three possible configurations. A first configuration (i.e., the first operating mode) of the tool allows fluid flow through a central flowbore of the cementing tool, a liner hanger setting tool below the cementing tool, and the liner. In the first operating mode, the central flowbore of the cementing tool is open, enabling fluid flow through the central flowbore. This first configuration may be used to provide traditional bottom-up cementing. A second configuration (i.e., the second operating mode) of the tool routes fluid from the central flowbore of the cementing tool to an annulus surrounding the liner hanger setting tool and the liner. Specifically, in the second operating mode, at least a portion of the central flowbore is closed and the one or more ports are open directing fluid flow outside of the cementing tool. This second configuration may be used to provide top-down cementing when, for example, relatively low pore pressures are expected in the wellbore to which the liner is being cemented. A third configuration (i.e., the third operating mode) of the tool provides flow through the central flowbore of the cementing tool and enables a dropped ball to reach the liner hanger setting tool. In the third operating mode, the shifting sleeve forms an internal flow path that circumvents the second seat, thereby enabling fluid flow through the central flowbore of the cementing tool. This third configuration may be used to set the liner hanger and/or to re-establish flow through the central flowbore of the cementing tool.

Although all three of these configurations are possible using the disclosed cementing tool, there is no requirement that the tool be placed in the second configuration and then the third configuration for setting the liner hanger. The disclosed cementing tool may be used for both fully traditional cementing operations as well as for bottom-up and top-down cementing operations, depending on the pore pressure of the wellbore. In instances where the pore pressure of the well is such that a top-down cement job is not necessary, then the disclosed cementing tool may be operated without ever being switched to the second configuration and third configuration. The cementing tool may be operated to perform a traditional fully bottom-up cement job, after which a relatively small sized ball or dart is landed in the liner hanger setting tool to set the liner while the cementing tool is still in its initial configuration. As such, the tool can be either switched from the first configuration to the second configuration and then to the third configuration, or the entire cementing operation may be performed with the tool in the first configuration, depending on the operational needs of the tool. The disclosed cementing tool therefore provides flexibility for use in different wellbores, as compared to existing top-down cementing tools.

In instances where the disclosed cementing tool is used to provide top-down cementing, the cementing tool may be switched from the first configuration to the second configuration via a dropped ball, which allows the cementing tool to begin top-down cementing immediately after finishing an initial bottom-up cementing phase and without waiting for the bottom cement to dry. During a top-down cementing operation in which the cementing tool is in the second configuration, cement is routed directly from drill pipe into the annulus and does not flow through the liner hanger setting tool. The disclosed cementing tool may be switched from the second configuration to the third configuration using either a dropped ball or a dart, which may be used to clear cement from the inner diameter of the drill pipe. Compared to existing top-down cementing tools, the disclosed cementing tool provides faster operating times and less potential for obstructing the central flowbore.

Turning now to the drawings, FIG. 1 illustrates an example liner installation work string 100 that may utilize the disclosed cementing tool 102. The work string 100 is positioned within a casing 104 in a wellbore 106, as shown. The work string 100 includes the cementing tool 102 and a liner hanger setting tool 108. During run-in, the liner hanger setting tool 108 is attached to a liner hanger 110 from which a liner 112 extends downward. The cementing tool 102 and liner hanger setting tool 108 may be supported in the wellbore 106 on a string of drill pipe 114 having a bore and a central axis 116. As illustrated, the disclosed cementing tool 102 is disposed above the liner hanger setting tool 108 (e.g., attached between the drill pipe 114 and the liner hanger setting tool 108).

Figure 2:
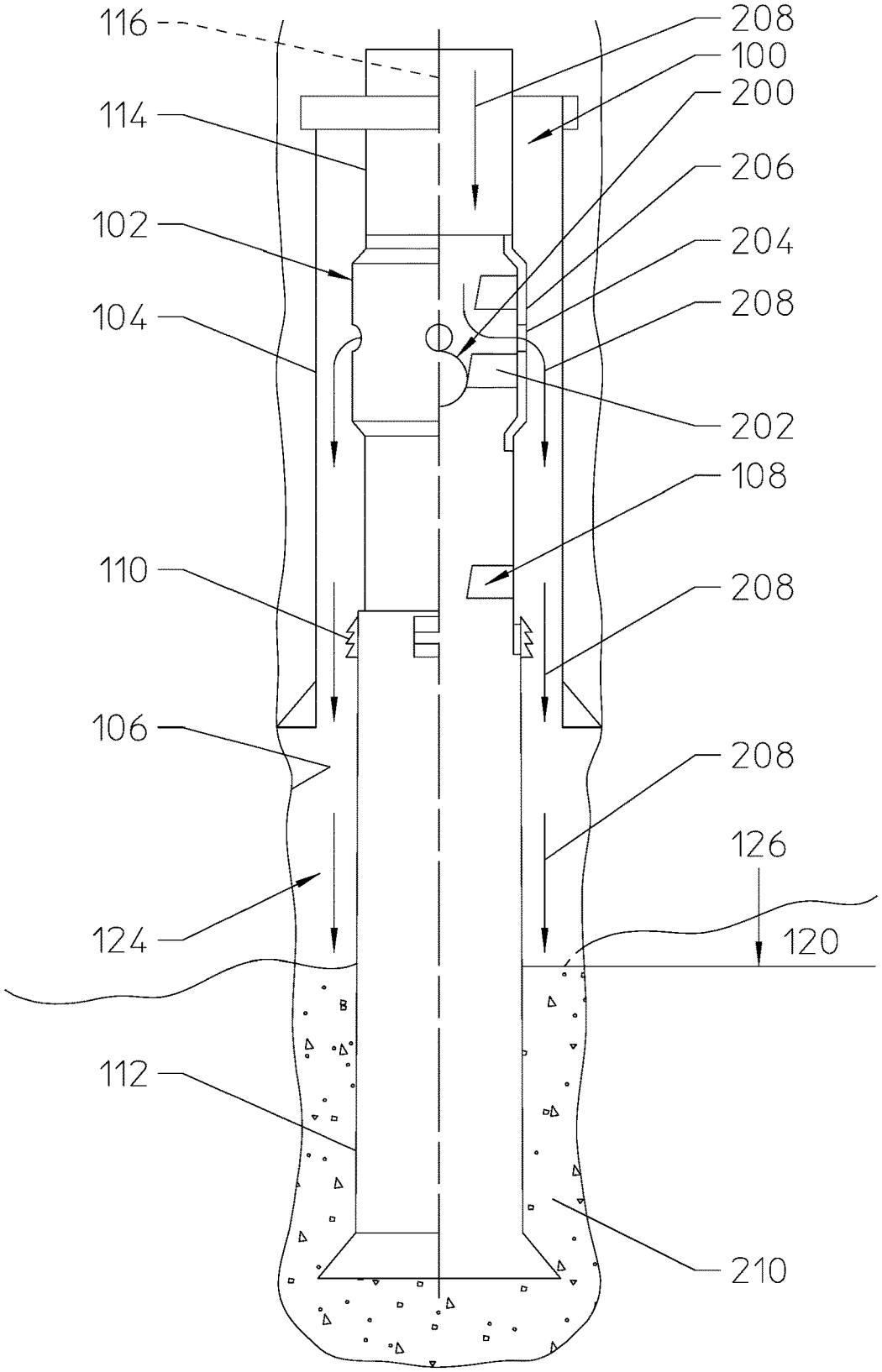
FIG. 2 is a schematic illustration of the work string of FIG. 1 with the cementing tool being used to facilitate top-down cementing, in accordance with an embodiment of the present disclosure.
Figure 3:
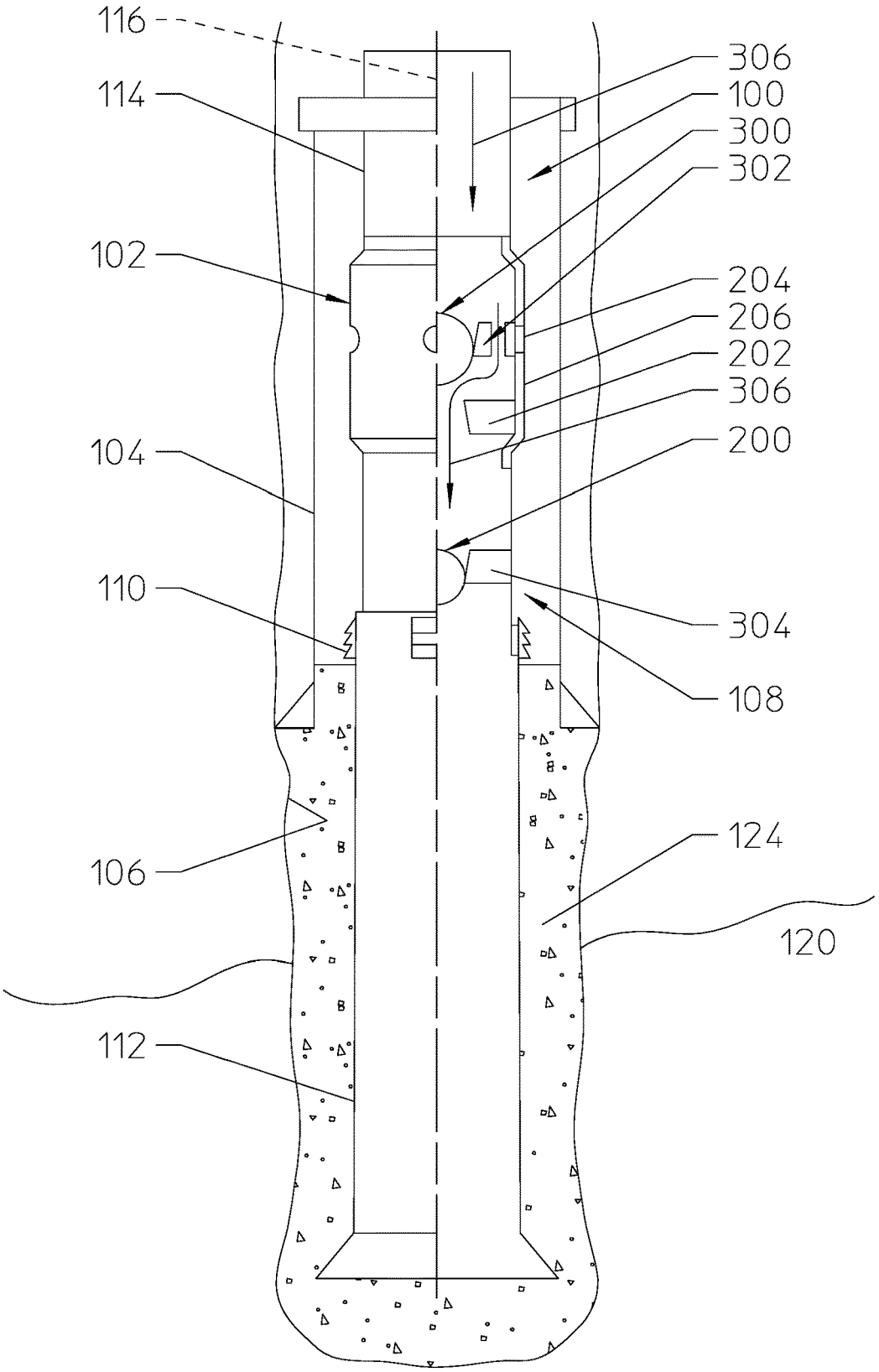
FIG. 3 is a schematic illustration of the work string of FIG. 1 with a ball that has passed through the cementing tool being used to set a liner hanger, in accordance with an embodiment of the present disclosure.

FIGS. 1-3 are schematic illustrations with the left-hand side half of the work string 100 illustrated as a front view and the right-hand side half of the work string 100 illustrated in a schematic section view. As such, the left-hand side half of the work string 100 shows the outside of the cementing tool 102, liner hanger 110, and liner 112, while the right-hand side half shows the inside of the cementing tool 102, liner hanger setting tool 108, and liner 110. Although FIGS. 1-3 provide a simplified line drawing of the basic internal components of the work string 100, FIGS. 4A-13 illustrate a more detailed version of the cementing tool 102 of FIGS. 1-3.

The cementing tool 102 may include a series of shifting sleeve(s), ball/plug seats, and ports that facilitate shifting the cementing tool 102 selectively between enabling flow through a central flowbore 118 of the cementing tool 102 and enabling flow into an annulus surrounding the cementing tool 102. In this way, the cementing tool 102 supports both traditional bottom-up liner cementing operations as well as top-down liner cementing operations. The disclosed cementing tool 102 may be particularly useful when cementing and setting a liner 112 in a wellbore 106 passing through formations 120 that have or are expected to have a low pore pressure.

If a well is expected to extend through a formation 120 with a low pore pressure, the disclosed cementing tool 102 is run in the installation work string 100 above the liner hanger setting tool 108 as shown. FIG. 1 shows the work string 100 during run-in. While the work string 100 is being run to the liner setting location, the cementing tool 102 is in a first configuration such that a flowpath is open through the central flowbore 118 of the cementing tool 102 connecting the drill pipe 114 to the liner hanger setting tool 108. Once the work string 100 is at the desired downhole location for cementing and setting the liner 112, cement may be circulated (arrows 122) down through the drill pipe 114, central flowbore 118 of the cementing tool 102, liner hanger setting tool 108, and out the bottom of the liner 112. This provides a bottom-up cementing operation where the cement is circulated into an annulus 124 outside the liner 112. Due to the pore pressure of the formation 120, it may not be possible to complete the entire cementing job via this traditional bottom-up cementing operation. Line 126 illustrates a maximum height to which cement may be pumped before exceeding a pore pressure of the formation 120 and causing leak-off.

If cement pumping pressures start to approach the pore pressure of the formation 120 and the liner 112 can only be cemented up to the thief zone (e.g., the maximum height 126), the cementing tool 102 may be switched to a second configuration to complete the cement job via a top-down cementing operation. FIG. 2 illustrates the cementing tool 102 in the second configuration. To switch the cementing tool 102 from the first configuration of FIG. 1 to the second configuration of FIG. 2, a ball 200 is dropped/pumped down the work string 100. The ball 200 lands in a lower seat 202 of the cementing tool 102, thereby closing off flow through the central flowbore (118 in FIG. 1) of the cementing tool 102. After the ball 200 is landed in the seat 202, pressure is applied down the work string 100 to actuate a shifting sleeve assembly that shifts the cementing tool 102 from the first configuration to the second configuration, opening ports 204 in an external body 206 of the cementing tool 102 so that fluid flow may be routed from the central flowbore of the cementing tool 102 directly into the annulus 124 between the work string 100 and the existing casing 104 and open hole below.

Once the cementing tool 102 is in the second configuration of FIG. 2, cement may be circulated (arrows 208) down through the drill pipe 114 and then from the cementing tool 102 directly into the annulus 124, without passing through the liner hanger setting tool 108 or liner 112. This provides a top-down cementing operation where the cement is released into the annulus 124 from a point above the liner 112. The annulus 124 is closed off at the wellhead at this time, and any cement now pumped down the work string 100 is directed into the annulus 124 between the top of the liner 112 and the thief zone (at line 126). The cement is pumped down the annulus 124 until it reaches a lower cemented portion 210 that was previously cemented from below. As the liner 112 is cemented from both below and above the thief zone (126), the cement job is completed.

After the cement job is complete, the cementing tool 102 may be switched to a third configuration to reestablish flow through the work string 100 and set the liner hanger 110. FIG. 3 illustrates the cementing tool 102 in the third configuration. To switch the cementing tool 102 from the second configuration of FIG. 2 to the third configuration of FIG. 3, a second ball 300 is dropped/pumped down the work string 100. The ball 300 lands in an upper seat 302 of the cementing tool 102, thereby closing off flow through the central flowbore (118 in FIG. 1) of the cementing tool 102 above the lower ball seat 202. After the ball 300 is landed in the seat 302, pressure is applied down the work string 100, causing the shifting sleeve assembly to shift the cementing tool 102 from the second configuration to the third configuration, closing off the ports 204 in the external body 206 of the cementing tool 102 and shifting various sleeves and component of the cementing tool 102 to release the first ball 200 from the lower ball seat 202. This closes off flow into the annulus 124 while reestablishing flow through the cementing tool 102. This shifting of the cementing tool 102 also releases the ball 200 that had previously been landed in the lower seat 202 to travel down the work string 100 and land in a seat 304 of the liner hanger setting tool 108. Pressure is then applied (arrows 306) through the work string 100 to actuate the liner hanger setting tool 108 that sets the liner hanger 110.

As discussed above, the disclosed cementer 102 has three main configurations (or operating modes), with the first position allowing traditional bottom-up circulation of cement, the second position routing cement into the annulus 124 in a top-down manner, and the third position restoring flow through the bottom of the cementing tool 102 and toward the liner hanger setting tool 108 to set the liner hanger 110.

In some instances, the disclosed cementing tool 102 may be included in a work string 100 that is lowered through a well with formation pore pressures that are high enough that top-down cementing (as shown in FIG. 2) is not required to complete the cement job. If it is determined that no top-down cement job is necessary, the cementing tool 102 may be kept in the first configuration (as shown in FIG. 1) throughout the entire cement job and while the liner hanger setting tool 108 is actuated. It is not necessary to shift the cementing tool 102 from the first to second configuration and from the second to third configuration to enable actuation of the liner hanger setting tool 108. Instead, the cementing tool 102 may be kept in the first configuration, and a relatively smaller sized ball or dart (smaller than ball 200) may be run through the work string 100 to land directly in the seat 304 of the liner hanger setting tool 108. The disclosed cementing tool 102 is thus never activated into the top-down cementing mode (second configuration). This decreases a risk of tool leakage that might otherwise occur using top-down cementing tools that must be shifted through each operating configuration before setting the liner hanger.

Having generally described the operation of the disclosed cementing tool 102 within the context of a liner installation work string 100, a more detailed description of the structure and function of shifting the cementing tool 102 between the first, second, and third configurations will now be provided. Reference will be made to FIGS. 4A-10B, which illustrate an embodiment of the cementing tool 102 as it is transitioned from a run-in position (first configuration) shown in FIGS. 4A-4B to a top-down cementing position (second configuration) shown in FIGS. 5A-5B and finally to a flow reestablishing position (third configuration) shown in FIGS. 10A-10B. Although a series of sleeves, shear screws, and other load lugs, and other components form the disclosed "shifting sleeve assembly" in FIGS. 4A-10B, it should be understood that other combinations of components may be utilized in other embodiments to provide the disclosed shifting of the cementing tool 102 between its three operating modes.

Figures 4A, 4B:
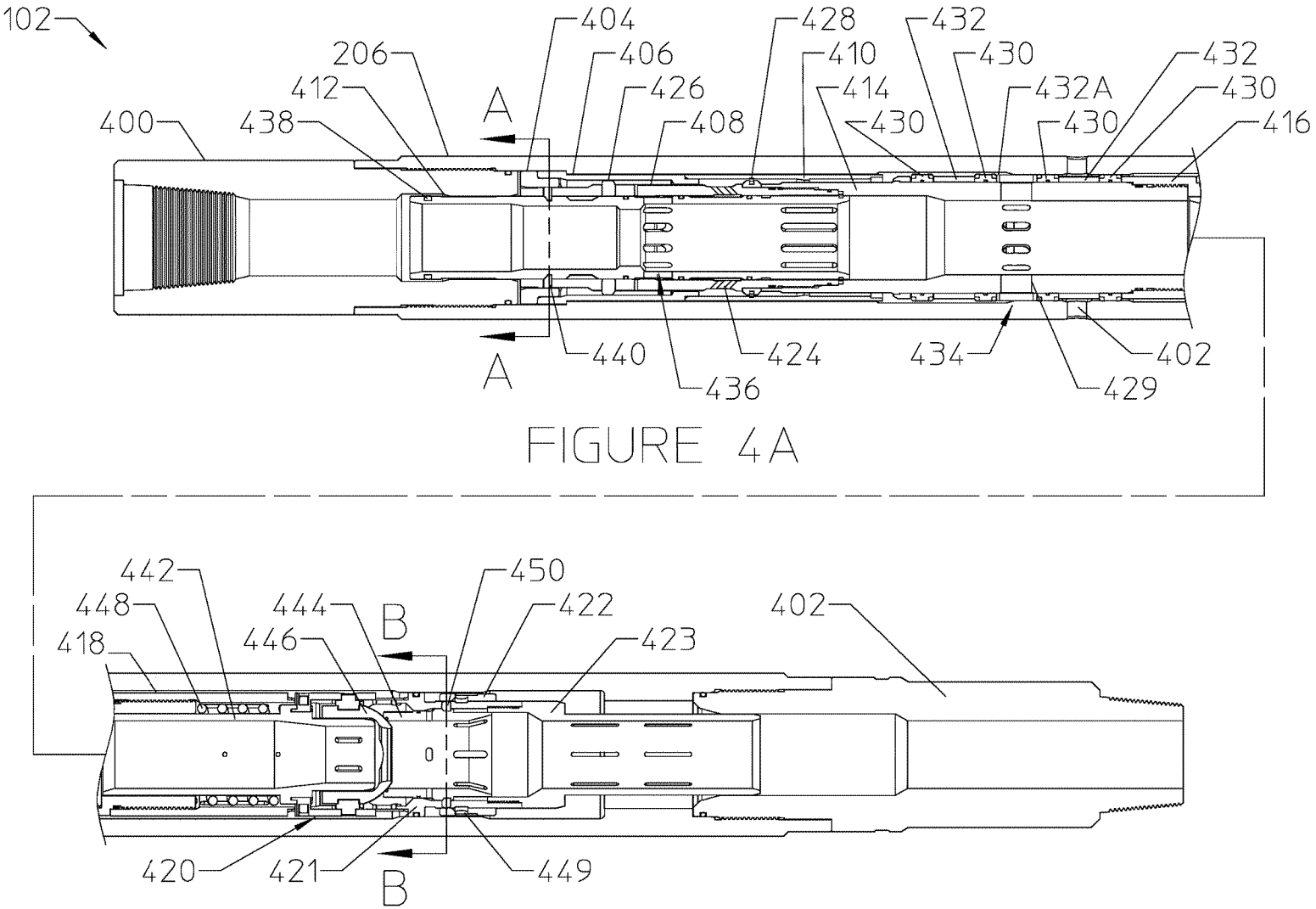
FIGS. 4A-4B are cross-sectional views of a cementing tool for use in the work string of FIGS. 1-3, the cementing tool being in a run-in position, in accordance with an embodiment of the present disclosure.

FIGS. 4A-4B illustrate the cementing tool 102 in the first configuration described above. This is the configuration in which the cementing tool 102 is run downhole, performs traditional bottom-up cement circulation, and if no top-down cementing is needed, allows a ball or dart to pass therethrough for actuating the below liner hanger setting tool.

The cementing tool 102 may include, among other things, an upper bushing 400, the external body 206, a lower bushing 402, a shear sleeve 404, a locating sleeve 406, a dog seal mandrel 408, a lock sleeve 410, a release sleeve 412, a lower dog seal mandrel 414, a piston connector 416, a ball sleeve 418, a rotating ball assembly 420, a ball mandrel 421, a shift sleeve 422, and a bottom guide 423. The external body 206 includes ports 204 at an axial location thereof, and houses the internal components of the cementing tool 102. The upper and lower bushings 400 and 402 may be threaded or otherwise connected to opposite ends of the body 206. The upper and lower bushings 400 and 402 may function as connectors for connecting the cementing tool 102 between the drill pipe and liner hanger setting tool (as shown in FIGS. 1-3).

The dog seal mandrel 408, the lower dog seal mandrel 414, and the piston connector 416 are located inside a bore of the body 206 and may be connected to each other end to end, e.g., via threads. Specifically, the lower dog seal mandrel 414 is generally connected between the dog seal mandrel 408 at its upper end and the piston connector 416 at its lower end. The dog seal mandrel 408 may include one or more flow paths extending therethrough (e.g., from a radially inner edge to a radially outer edge thereof). For example, the dog seal mandrel 408 may include a plurality of circulation slots 424 formed therethrough at a certain axial position. As illustrated, the circulation slots 424 extending through the dog seal mandrel 408 may be inclined with respect to a radial direction perpendicular to the longitudinal axis of the cementing tool 102. This inclined orientation may help to direct flow around a ball seat (e.g., 302 of FIG. 3) when the cementing tool 102 in its third configuration. One or more load lugs 426 may extend in a radially outward direction from the dog seal mandrel 408. The one or more load lugs 426 may be positioned at an axial position located above the axial position of the slots 424. A locking mechanism 428 may be disposed around an outer diameter of the dog seal mandrel 408. The locking mechanism 428 may be positioned at an axial position located below the axial position of the slots 424. In the illustrated embodiment, the locking mechanism 428 may be a c-ring assembly. However, other types of locking mechanisms 428 may be used in other embodiments. The lower dog seal mandrel 414 may include one or more ports 429 formed therethrough at an axial location.

As illustrated, the shear sleeve 404, the locating sleeve 406, and the lock sleeve 410 may each be disposed within an annular space between an outer diameter of the dog sleeve mandrel 408 and an inner diameter of the body 206. The shear sleeve 404 may extend at least partially internal to the locating sleeve 406 in a radial direction. The locating sleeve 406 may be attached in an axial direction to the lock sleeve 410 at its lower end, as shown. An alternating series of bonded seals 430 and spacers 432 may be located radially between an outer diameter of the lower dog seal mandrel 414 and an inner diameter of the body 206. One of the spacers 432A may include one or more ports 434 formed therethrough. For example, in the illustrated embodiment, the spacer 432A includes a plurality of ports 434 positioned circumferentially around the spacer 432A and extending radially through the spacer 432A. In the run-in configuration of FIGS. 4A-4B, the port(s) 434 are not aligned (e.g., not located at a same axial location) with the ports 204 through the body 206.

The release sleeve 412 may be located within a bore of one or both of the upper bushing 400 and the dog seal mandrel 408. The release sleeve 412 may include one or more flow paths extending therethrough (e.g., from a radially inner edge to a radially outer edge thereof). For example, the release sleeve 412 may include a plurality of slots 436 formed therethrough at a certain axial position. As illustrated, the slots 436 extending through the release sleeve 412 may be inclined with respect to a radial direction perpendicular to the longitudinal axis of the cementing tool 102. This inclined orientation may help to direct flow around a ball seat (e.g., 302 of FIG. 3) when the cementing tool 102 in its third configuration. The slots 436 may be oriented at an incline equivalent to the incline of the slots 424 through the dog seal mandrel 408. The slots 436 may be positioned at the same circumferential positions around the release sleeve 412 as the slots 424 are around the dog seal mandrel 408. The release sleeve 412 may include a D-seal 438 at an upper end thereof that is configured to seal against the inner diameter of the upper bushing 400 at certain points during shifting of the cementing tool 102. One or more keys 440 may extend radially inward from the dog seal mandrel 408 into one or more corresponding grooves in an outer diameter of the release sleeve 412.

The piston connector 416 may axially attach a lower end of the lower dog seal mandrel 414 to an upper end of the ball sleeve 418. The piston connector 416 may be connected to each of these components 414 and 418 via threads, as shown. However, other types of connectors may be used to attach the lower dog seal mandrel 414 to the ball sleeve 418 in other embodiments. The piston connector 416 and the ball sleeve 418 may each abut the rotating ball assembly 420. The rotating ball assembly 420 may include, among other things, an upper seat 442, a lower seat 444, a rotatable ball 446, and a compression spring 448. The rotatable ball 446 is initially seated between the upper and lower seats 442 and 444 in an orientation where a restricted flow path is provided through the ball 446. As such, the ball 446 may function as the lower seat 202 of the cementing tool 102 described above with reference to FIG. 2. The compression spring 448 may be located axially between a lower end of the piston connector 416 and shoulder of the upper seat 442. The overall ball assembly 420 may be of a similar type and function to the downhole ball circulation tool disclosed within U.S. Pat. No. 7,318,479 to TIW Corporation, which is hereby incorporated by reference. The rotating ball assembly 420, upon actuation, may rotate the ball 446 such that the ball 446 is then seated between the upper and lower seats 442 and 444 in an orientation where an enlarged flow path is provided through the ball 446.

The ball mandrel 421 may be located radially between an outer diameter of the lower seat 444 and an inner diameter of the shift sleeve 422. The shift sleeve 422 may be located radially between the outer diameter of the ball mandrel 421 and the inner diameter of the body 206. The bottom guide 423 may be connected to a lower end of the ball mandrel 421, and a lower end of the bottom guide 423 may extend into the bore of the lower bushing 402. As illustrated, the shift sleeve 422 may include one or more grooves 449 formed into an inner diameter thereof at a certain axial position. The ball mandrel 421 may include one or more release dogs 450 biased in a radially outward direction from the ball mandrel 421, and in the run-in configuration these release dogs 450 may be held against an inner diameter of the shift sleeve 422 (i.e., axially offset from the one or more grooves 449).

Having described the general structure of the cementing tool 102 of FIGS. 4A-10B, a detailed description of the operations of the cementing tool 102 moving between various configurations will now be provided. As mentioned above, FIGS. 4A-4B show the cementing tool 102 in the first configuration in which the system is run into the well and used to provide any bottom-up cementing operations. To that end, the cementing tool 102 allows flow straight through the inner flowbore of the cementing tool 102 (e.g., through each of the upper bushing 400, release sleeve 412, lower dog seal mandrel 414, rotating ball assembly 420, bottom guide 423, and lower bushing 402).

Figures 5A, 5B:
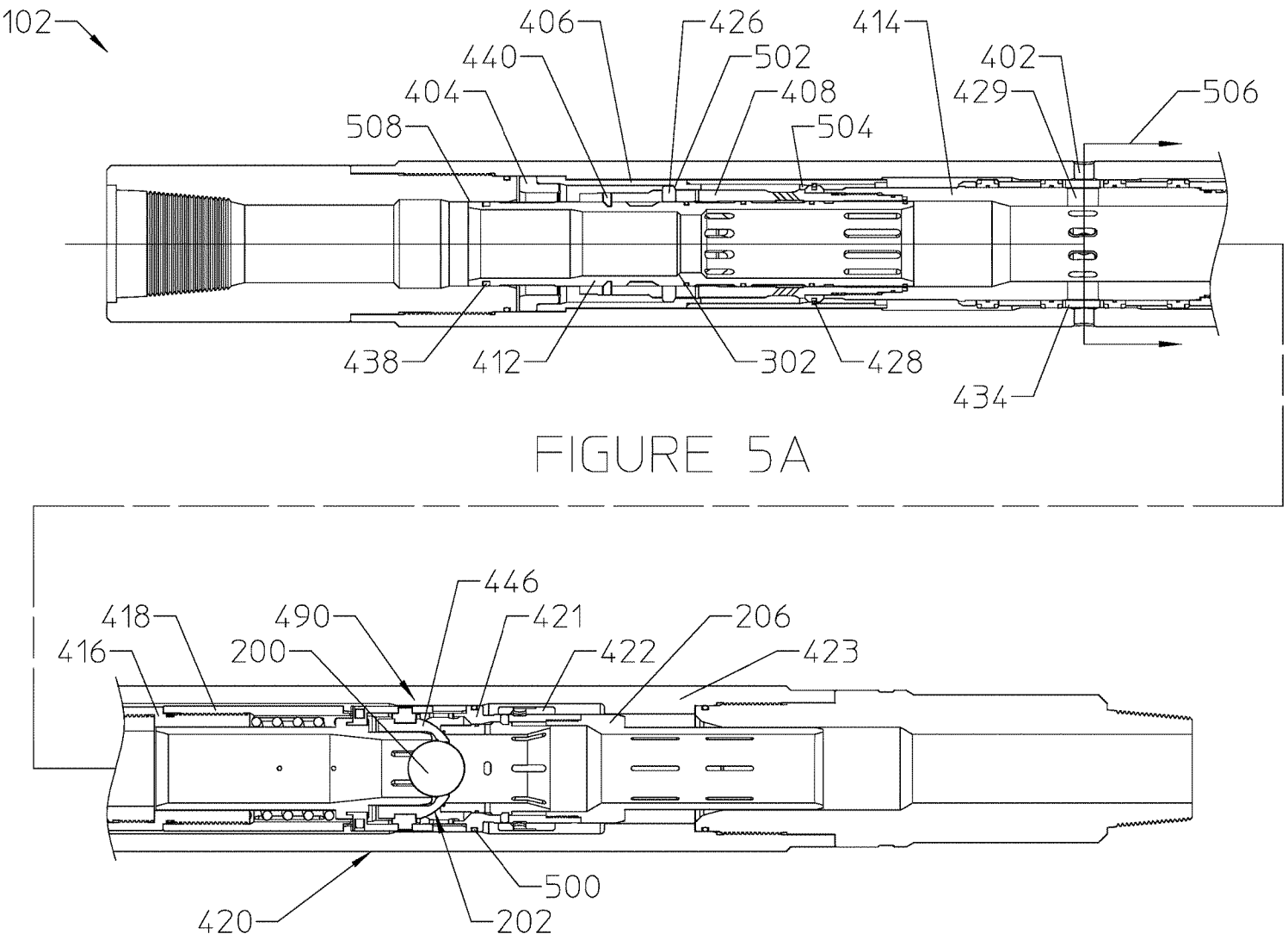
FIGS. 5A-5B are cross-sectional views of the cementing tool of FIGS. 4A-4B with a first ball landed and providing top-down cementing through an annulus, in accordance with an embodiment of the present disclosure.

FIGS. 5A-5B illustrate the cementing tool 102 once it has shifted to the second configuration for top-down cementing. The process of shifting the cementing tool 102 from the first configuration (run-in) to the second configuration (top-down cementing) may involve the following steps. First, the ball 200 is dropped and pumped into the central flowbore of the cementing tool 102 until it catches on the seat 202 formed by the rotating ball 446. In some embodiments, an outer diameter of the ball 200 may be between approximately 1.5 and 5 inches, more particularly between approximately 2.5 and 4 inches, or more particularly approximately 3.25 inches. Regardless of the exact size of the ball 200, the ball 200 is large enough to seat on and block flow through the restricted flowpath of the rotating ball 446 but small enough to pass through the enlarged flowpath of the rotating ball 446 and the upper seat 302 formed along the internal diameter of the release sleeve 412.

Landing the ball 200 in the seat 202 allows pressure to build behind a piston assembly 490 of the cementing tool 102. This piston assembly 490 may include one or more internal components of the cementing tool 102. For example, in the illustrated embodiment, the piston assembly 490 may include the rotating ball assembly 420, the ball mandrel 421, the dog seal mandrel 408, the release sleeve 412, the lower dog seal mandrel 414, the piston connector 416, the ball sleeve 418, the shift sleeve 422, the bottom guide, and/or other attached components. An outer diameter of the hydraulic piston area for this piston assembly 490 is defined by an interface between an o-ring 500 at an outer diameter of the ball mandrel 421 and the inner diameter of the body 206.

Figure 11:
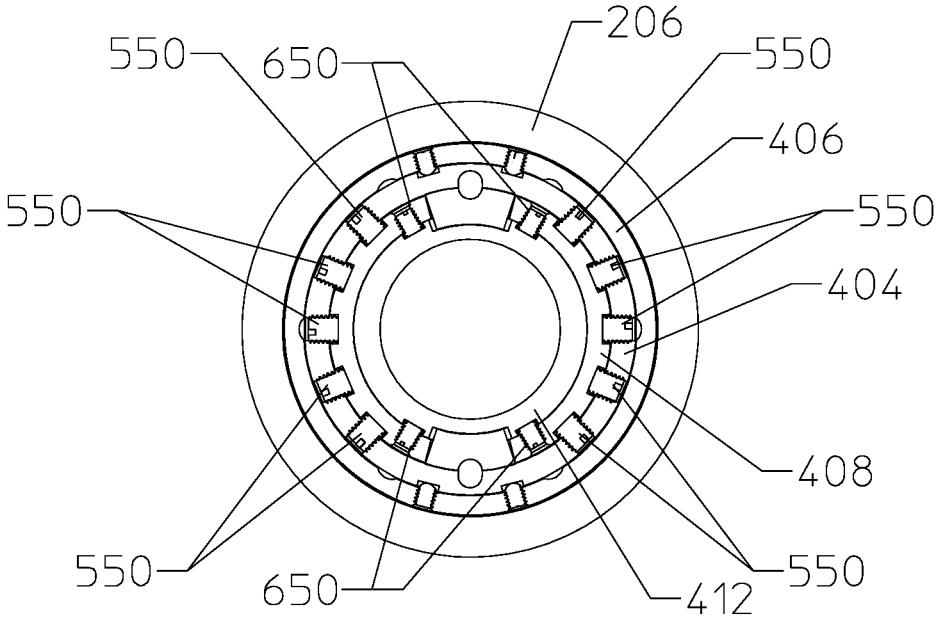
FIG. 11 is a cross-sectional view of the cementing tool of FIG. 4A taken at line A-A, in accordance with an embodiment of the present disclosure.

Once pressure is applied behind the ball 200, a downward force is transferred through the piston assembly 490. This downward force shears one or more shear screws located between an inner diameter of the shear sleeve 404 and an outer diameter of the dog seal mandrel 408. Although the one or more shear screws are not visible in the view of FIGS. 5A-5B, such shear screws 550 are shown in FIG. 11. FIG. 11 is a section view of the cementing tool 102 taken at line A-A of FIG. 4A before the shear screw(s) 550 have been sheared (i.e., when the cementing tool 102 is still in the first configuration). Upon shearing the shear screw(s) 550 between the shear sleeve 404 and the dog seal mandrel 408, the piston assembly 490 is able to move axially downward relative to the body 206 of the cementing tool 102 by a certain amount, as shown in FIGS. 5A-5B. For example, in some embodiments, the dog seal mandrel 408 and other attached components of the piston assembly 490 may shift axially downward by an amount between approximately 2 inches and 5 inches, more particularly between approximately 3 inches and 4 inches, or more particularly approximately 3.640 inches. This downward motion may be stopped when the load lugs 426 in the dog seal mandrel 408 contact a shoulder 502 on an inner diameter of the locating sleeve 406.

In addition, the downward motion of the piston assembly 490 may cause the locking mechanism 428 (e.g., c-ring assembly) on the outside of the dog seal mandrel 408 to move along an inner diameter of the lock sleeve 410. The c-ring assembly 428 may include a retainer with a c-ring disposed therein, wherein the c-ring is biased in a radially outward direction but is able to be compressed in a radially inward direction to be received further into the retainer. As the c-ring assembly 428 moves axially downward with the rest of the piston assembly 490, it passes a profile 504 formed on the inner diameter of the lock sleeve 410. This profile 504 may force the c-ring of the c-ring assembly 428 into a compressed position until the c-ring assembly 428 passes beyond the lower edge of the profile 504. After passing the profile 504, the c-ring may expand back outward and prevent the dog seal mandrel 408 from moving back in an axially upward direction.

In addition, the downward motion of the piston assembly 490 may reposition the lower dog seal mandrel 414 such that the ports 429 through the lower dog seal mandrel 414 and the ports 434 through the spacer 430A are aligned with the ports 204 through the outer body 206 of the cementing tool 102. This allows communication 506 of fluid from the central flowbore of the cementing tool 102 through the ports 204 in the outer diameter of the body 206 and into the annulus surrounding the cementing tool 102. As such, the cementing tool 102 may in this second configuration provide top-down cementing.

In addition, the downward motion of the piston assembly 490 may pull the D-seal 438 at an upper end of the release sleeve 412 into an inner seal bore 508 of the upper bushing 400, thereby creating a seal at the interface of the D-seal 438 and the upper bushing 400. In addition, the keys 440 that previously prevented motion of the release sleeve 412 relative to the dog seal mandrel 408 are uncovered in a radially outward direction. This uncovering of the keys 440 may later allow shear screws at the same location to shear.

As shown in FIGS. 5A-5B, the ball 200 remains seated within the rotating ball assembly 420 during the entire top-down cementing operation. Seating a ball 200 at this location within the cementing tool 102 and pressuring up to provide the top-down cementing operation may be particularly useful. First, this configuration does not require a cement wiper plug to land/bump at a lower end of the work string. Instead, the ball 200 is landed at a relatively higher position (within the cementing tool 102) for the entire second stage of top-down cementing. In addition, there is no need to wait for the bottom-up cement to set prior to conducting the top-down cement job (e.g., due to the possibility of a wet shoe). This can save a considerable amount of rig time. In addition, the disclosed cementing tool 102 closes off the drill pipe below the ball seat 202 so that all of the top-down cement job is routed to the annulus as opposed to being routed through the liner hanger setting tool below.

Figures 6A, 6B:
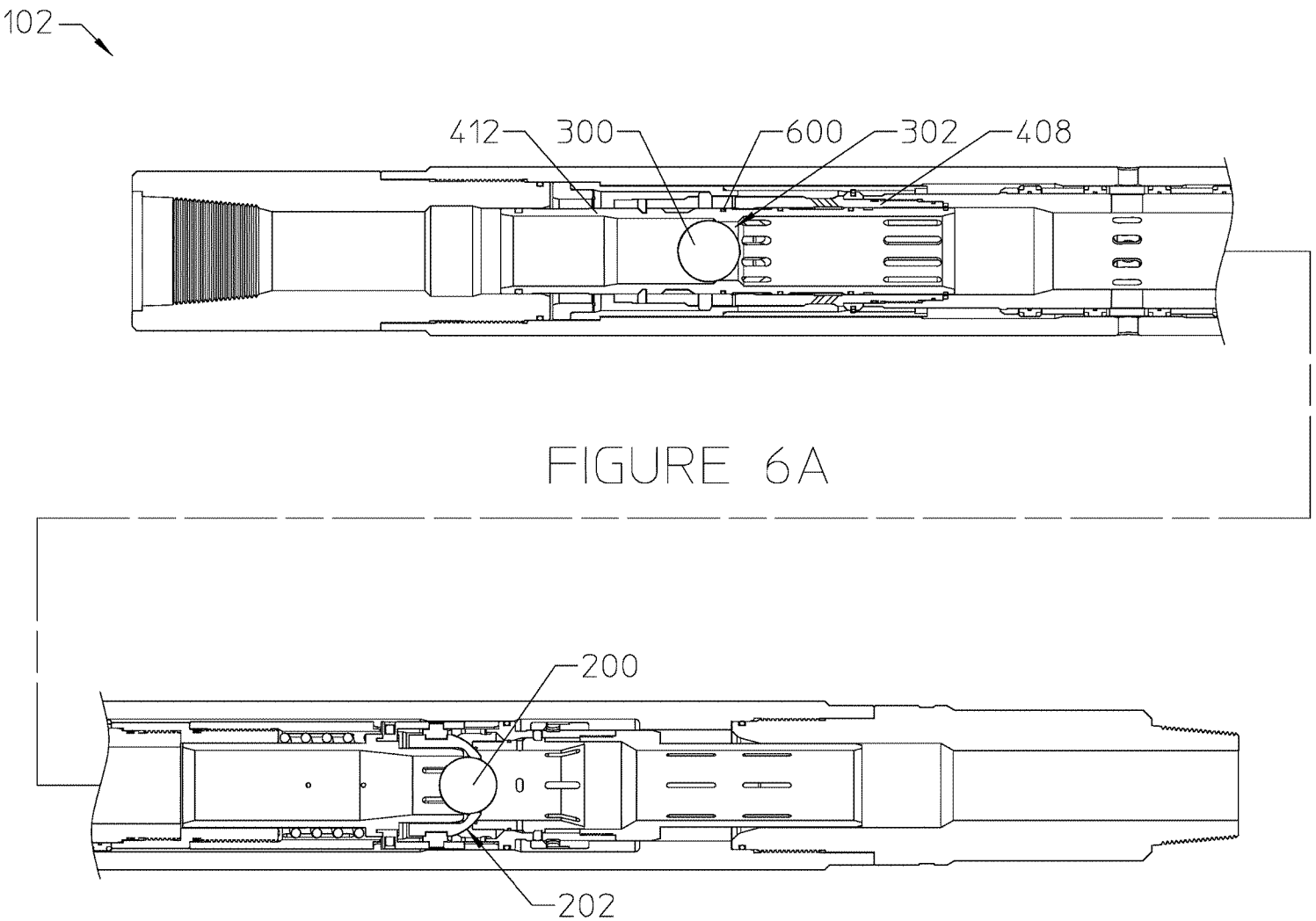
FIGS. 6A-6B are cross-sectional views of the cementing tool of FIGS. 4A-5B with a second ball landed, in accordance with an embodiment of the present disclosure.

Once the top-down cementing job is completed, the cementing tool 102 may then be shifted to the third configuration for reestablishing fluid flow through its central flowbore and releasing the ball 200 to set the liner hanger. FIGS. 6A-10B show this progression. The process begins at FIGS. 6A and 6B with dropping and pumping a relatively larger second ball (or dart/plug) 300 into the cementing tool 102. In some embodiments, the ball or dart may have an outer diameter of between approximately 1.5 and 5.5 inches, more particularly between approximately 2.5 and 4.5 inches, or more particularly approximately 3.5 inches. Regardless of the exact size of the ball, dart, or plug 300, the outer diameter of the ball, dart, or plug 300 is greater than the diameter of the previously dropped ball (e.g., 200). This enables the previously dropped ball 200 to land in the lower seat prior to dropping the ball, dart, or plug 300 and shifting the cementing tool 102 from the second configuration to the third configuration. The ball, dart, or plug 300 may catch in the seat 302 formed along the inner diameter of the release sleeve 412, as shown in FIG. 6A.

The release sleeve 412 and components of the cementing tool 102 above the release sleeve 412 are sized with an inner diameter that is large enough to pass a ball, dart, or plug. As such, while a ball (e.g., 200) is used to transition the cementing tool 102 from the first to the second configuration, another ball, dart, or plug 300 may be used to transition the cementing tool 102 from the second to the third position. This is different from other top-down cementing tools that generally require the use of dropped balls only to reconfigure the cementing tool. When a dart or plug is used for component 300, the dart or plug may include wiper features extending radially outward therefrom and designed to clear cement from the inner diameter of the drill pipe located above the cementing tool 102.

Upon dropping and seating the ball, dart, or plug 300 in the seat 302, this initially creates a piston 610 with its outer seal at an o-ring 600 between an outer diameter of the release sleeve 412 and an inner diameter of the dog seal mandrel 408. This initial piston 610 generally includes the release sleeve 412.

Pressure is increased behind the ball or plug 300. This increased pressure may shear one or more shear screws located between an outer diameter of the release sleeve 412 and an inner diameter of the dog seal mandrel 408, allowing the release sleeve 412 to then move downward relative to the dog seal mandrel 408. Although the shear screw(s) are not visible in the view of FIGS. 6A-6B, these shear screw(s) 650 are shown in FIG. 11.

Figures 7A, 7B:
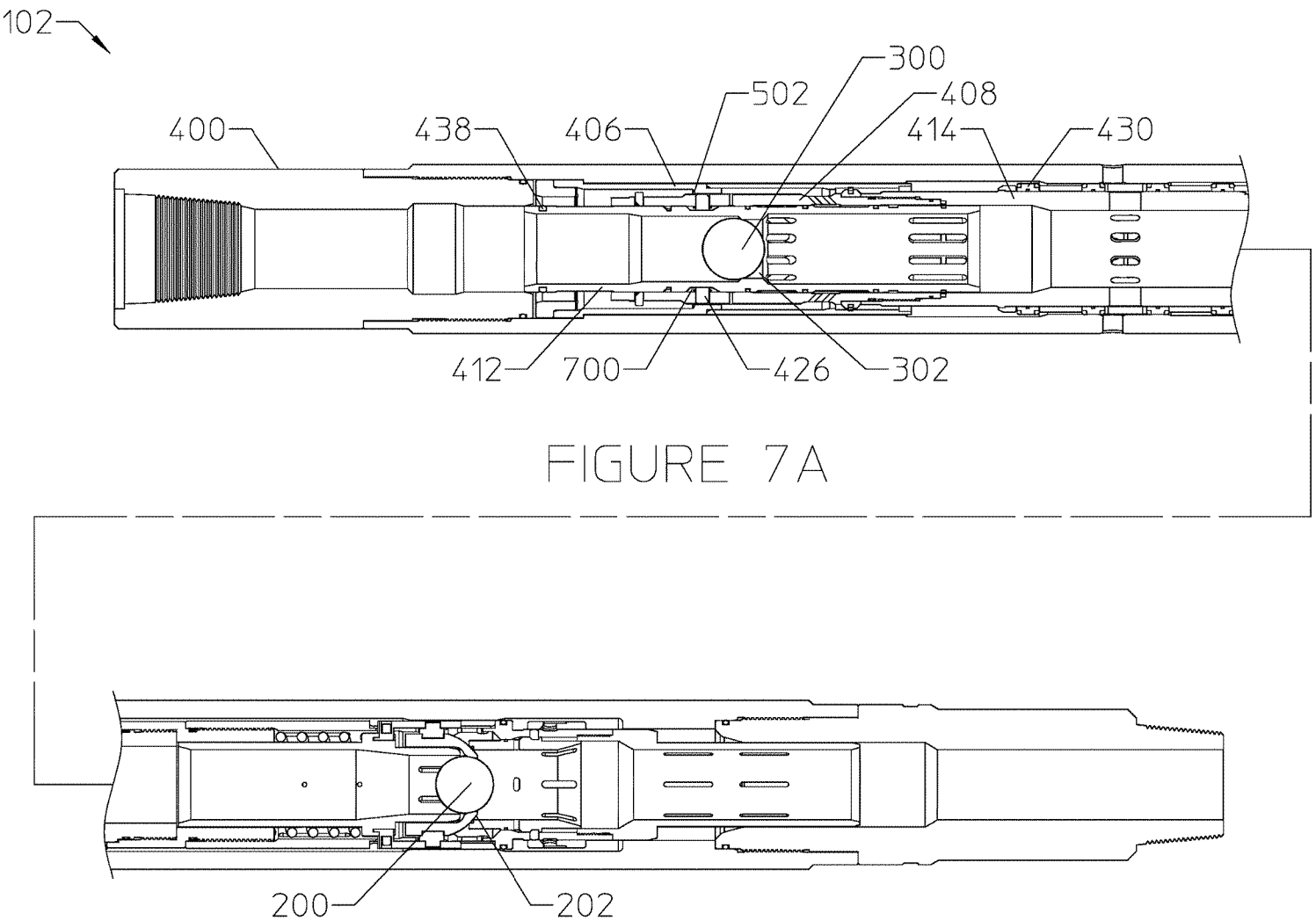
FIGS. 7A-7B are cross-sectional views of the cementing tool of FIGS. 4A-6B with internal components of the cementing tool shifting downward, in accordance with an embodiment of the present disclosure.

FIGS. 7A-7B illustrate the resulting downward movement of the release sleeve 412 relative to the dog seal mandrel 408 as the piston assembly 610 begins to stroke downward. This movement may cause a groove 700 formed along an outer diameter of the release sleeve 412 to move under the load lugs 426, thereby unloading the load lugs 426 from their position against the inner diameter (and against the shoulder 502) of the locating sleeve 406. This allows the load lugs 426 to move past the shoulder 502 of the locating sleeve 406, allowing the dog seal mandrel 408 to move axially downward with the release sleeve 412 relative to the body 206. At this point, the dog seal mandrel 408 may form part of the piston assembly 610 as well. As the release sleeve 412 and the rest of the piston assembly 610 move downward, the D-seal 438 at the top of the release sleeve 412 may be uncovered (i.e., disengaged from the seal bore of the upper bushing 400) and this allows pressure to reach the uppermost bonded seal 430 surrounding the lower dog seal mandrel 414. This uppermost bonded seal 430 may then define a hydraulic piston area for a new piston assembly 710. Below the uppermost bonded seal 430, the components of the cementing tool 102 are not under applied pressure.

Figures 8A, 8B:
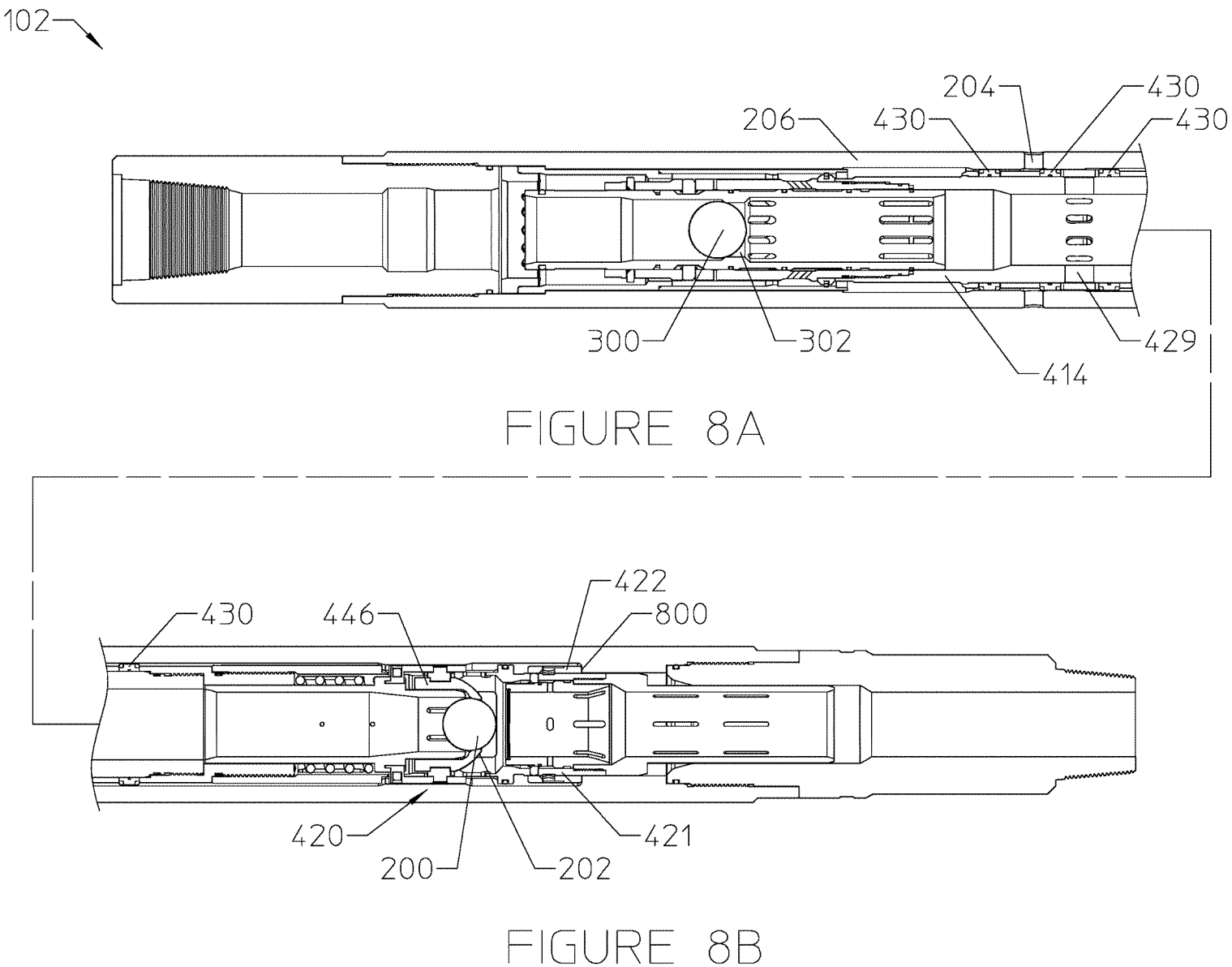
FIGS. 8A-8B are cross-sectional views of the cementing tool of FIGS. 4A-7B with internal components of the cementing tool shutting a flow path to the annulus surrounding the cementing tool, in accordance with an embodiment of the present disclosure.

As the new piston assembly 710 (including the lower dog seal mandrel 414 and associated bonded seals 430) moves downward, the flow path to the annulus surrounding the cementing tool 102 may be shut off, as shown in FIGS. 8A and 8B. Specifically, the piston assembly 710 may move downward relative to the body 206 until the bonded seals 430 separate the ports 429 through the lower dog seal mandrel 414 from the ports 204 through the body 206.

Figure 12:
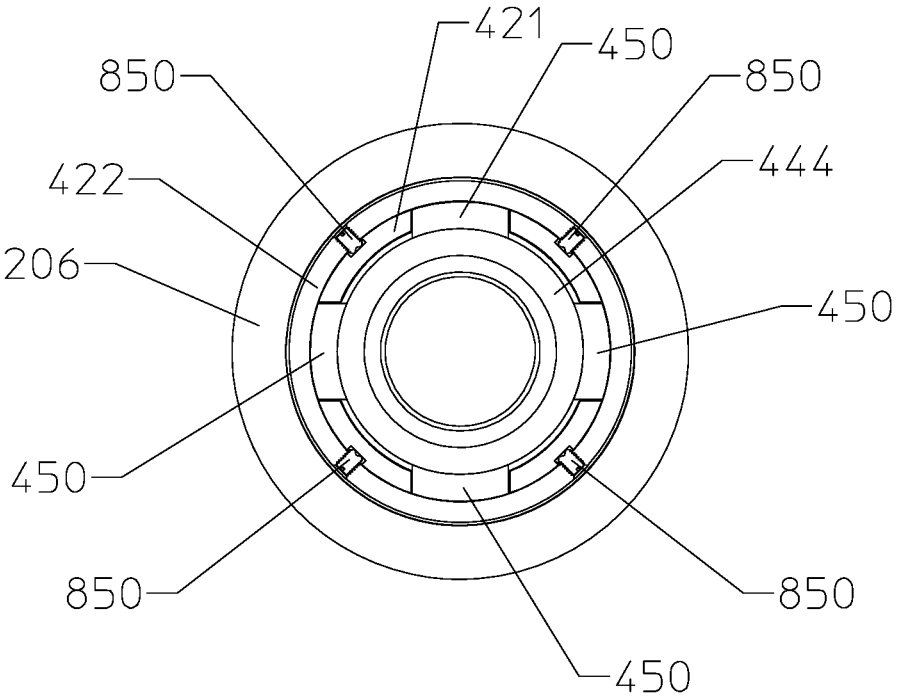
FIG. 12 is a cross-sectional view of the cementing tool of FIG. 4B taken at line B-B, in accordance with an embodiment of the present disclosure.

In addition, as the piston assembly 710 moves downward the shift sleeve 422 may contact a shoulder 800 formed on an inner diameter of the body 206. This may cause one or more shear screws located between the shift sleeve 422 and the ball mandrel 421 to shear. Although these shear screw(s) are not visible in the view of FIGS. 8A-8B, these shear screw(s) 850 are shown in FIG. 12. FIG. 12 is a section view of the cementing tool 102 taken at line B-B of FIG. 4B before the shear screw(s) 850 have been sheared (i.e., when the cementing tool 102 is still in the first configuration). Upon shearing the screw(s) 850 between the shift sleeve 422 and the ball mandrel 421, the rotating ball assembly 420 is able to be actuated to rotate the ball 446 as discussed below.

Figures 9A, 9B:
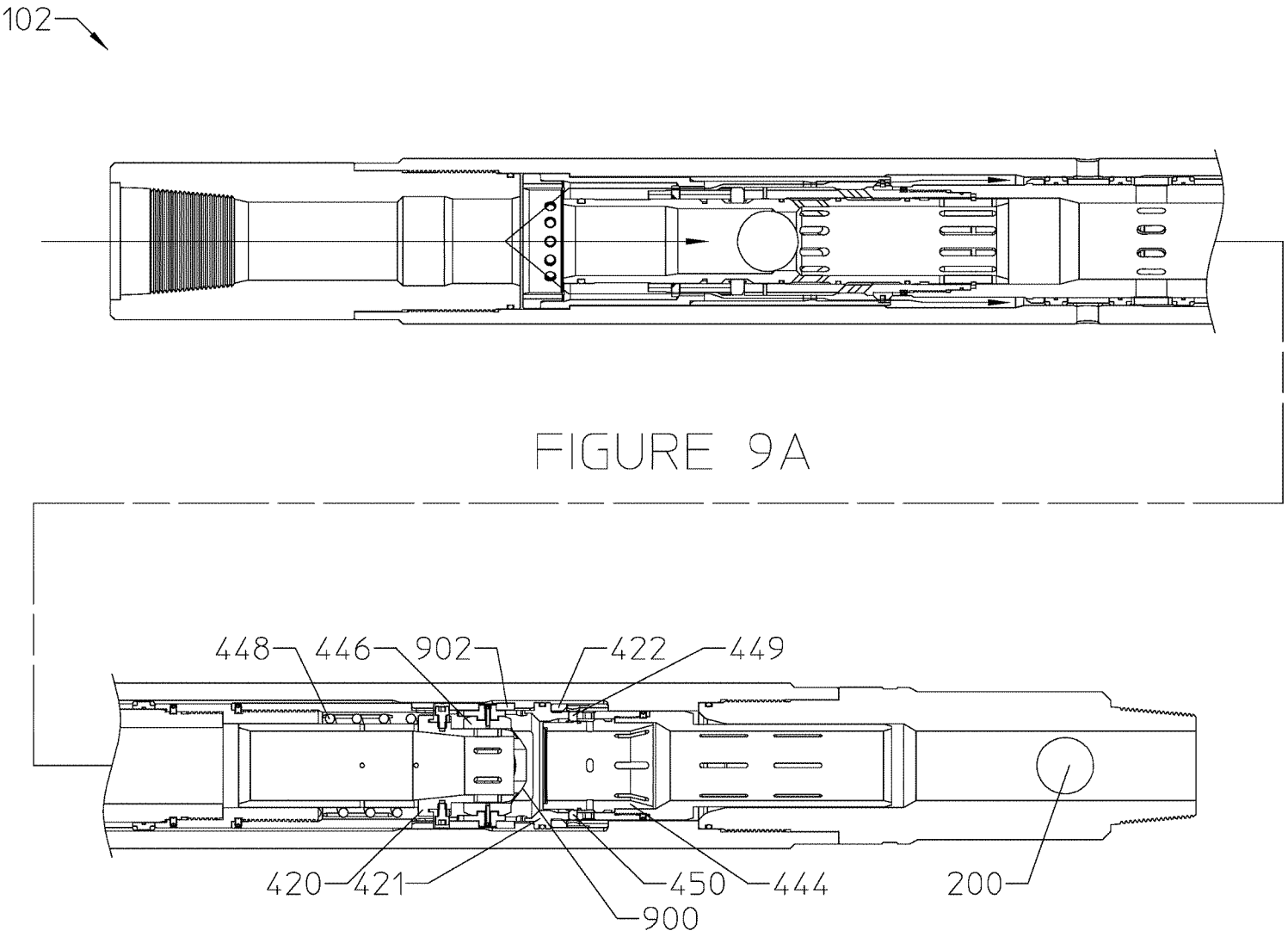
FIGS. 9A-9B are cross-sectional views of the cementing tool of FIGS. 4A-8B releasing the first ball, in accordance with an embodiment of the present disclosure.

As the piston assembly 710 continues to move downward, the ball mandrel 421 may move axially downward with respect to the shift sleeve 422, as shown in FIGS. 9A-9B. This movement may cause the set of release dogs 450 in the outer diameter of the ball mandrel 421 to be uncovered and expand radially outward into the grooves 449 within the shift sleeve 422. The release dogs 450 are thus disengaged from a corresponding groove in the outer diameter of the lower seat 444 of the rotating ball assembly 420. The lower seat 444 may then be pushed downward by the rotating ball 446, whose mechanism is being pushed downward by the compression spring 448. Cam mechanisms of the rotating ball assembly 420 rotate the ball 446 from the orientation with the restricted flowpath to an orientation with an enlarged flowpath 900 in the axial direction. This rotation of the ball 446 allows the previously seated ball 200 to be released from the seat and to travel downhole toward the liner hanger setting tool, where the ball 200 can be used to set the liner. Using the rotating ball assembly 420 to release the ball 200, as opposed to an expandable cone, provides a fully unrestricted bore through the cementing tool 102 for any process that comes after the cementing operation.

Figures 10A, 10B:
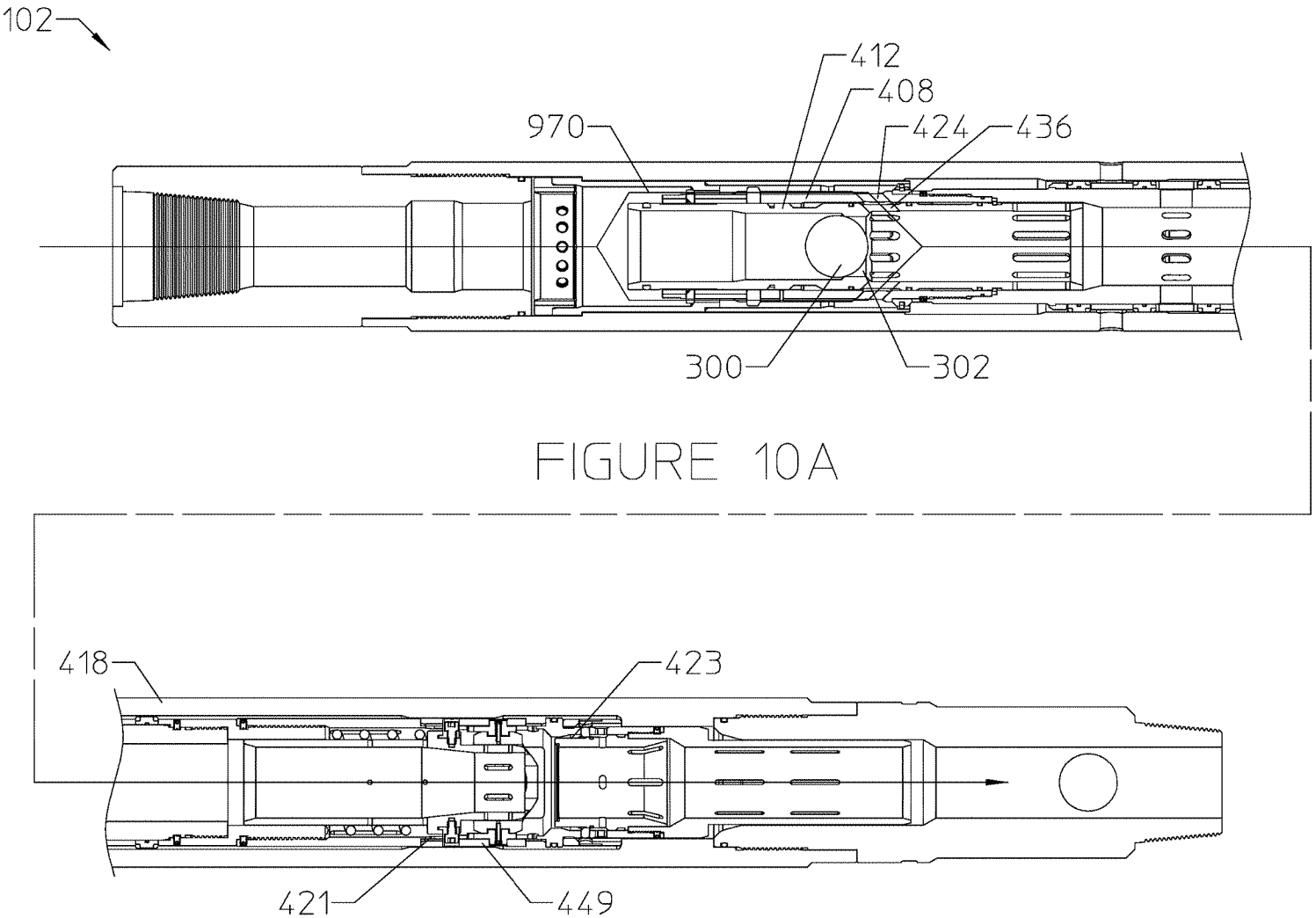
FIGS. 10A-10B are cross-sectional views of the cementing tool of FIGS. 4A-9B shifting to a position that re-establishes flow through a central flowbore, in accordance with an embodiment of the present disclosure.

A lower end of the piston assembly 710 (e.g., at the radially extended portion of the ball mandrel 421) may be caught on a shoulder 902 of the shift sleeve 422. Continued increasing pressure on the piston assembly 710 may move the release sleeve 412 further downward, pushing the load lugs 426 radially outward via a slanted edge of the groove 700 until the load lugs 426 move completely out of the groove 700 in the release sleeve 412. With the load lugs 426 out of the groove 700, the release sleeve 412 is able to shift further axially downward, as shown in FIGS. 10A-10B. As the release sleeve 412 moves axially downward inside of the dog seal mandrel 408, this may open a new flow path 970 that directs fluid flow around the outer diameter of the release sleeve 412 and then through the slots 424 and 436 in the dog seal mandrel 408 and the release sleeve 412, respectively. This flow path 970 bypasses the ball, dart, or plug 300, which remains landed in the seat 302. This may restore a through flowpath within the cementing tool 102, thereby placing the cementing tool 102 in the third configuration.

Although the present disclosure and its advantages have been described in detail, it should be understood that various changes, substitutions and alterations can be made herein without departing from the spirit and scope of the disclosure as defined by the following claims.

What is claimed is:

1. A cementing tool, comprising:

a body;

one or more ports extending through the body;

a first seat internal to the body and configured to receive a ball landed thereon;

a second seat internal to the body and configured to receive a ball, dart, or plug landed thereon; and a shifting sleeve assembly internal to the body and configured to selectively transition the cementing tool from a first operating mode to a second operating mode and from the second operating mode to a third operating mode, wherein:

in the first operating mode, a central flowbore of the cementing tool is open;

in the second operating mode, a ball is landed on the first seat, at least a portion of the central flowbore is closed, and the one or more ports are open; and in the third operating mode, the ball is released from the first seat, a ball, dart, or plug is landed on the second seat, and the shifting sleeve forms an internal flow path that circumvents the second seat.

2. The cementing tool of claim 1, further comprising an actuator coupled to the first seat, wherein the first seat is configured to release the ball therefrom upon actuation of the first seat by the actuator.

3. The cementing tool of claim 1, wherein the first seat comprises a rotatable ball having two different sized flow paths formed therethrough, wherein the rotatable ball is rotatable between a first position in which a first flow path is aligned with the central flowbore and a second position in which a second flow path is aligned with the central flowbore.

4. The cementing tool of claim 1, wherein the first seat is configured to receive a ball having a first outer diameter thereon and wherein the second seat is configured to receive a ball, dart, or plug having a second outer diameter thereon, the second outer diameter being greater than the first outer diameter.

5. The cementing tool of claim 1, wherein the second seat is located axially above the first seat.

6. The cementing tool of claim 5, wherein the one or more ports are located at an axial position between the first seat and the second seat.

7. A liner installation work string, comprising:

a liner hanger setting tool; and a cementing tool coupled to the liner hanger setting tool and having a central flowbore in fluid communication with a flowbore of the liner hanger setting tool, the cementing tool comprising:

a body;

one or more ports extending through the body;

a first seat internal to the body and configured to receive a ball landed thereon;

a second seat internal to the body and configured to receive a ball, dart, or plug landed thereon; and a shifting sleeve assembly internal to the body and configured to selectively transition the cementing tool from a first operating mode to a second operating mode and from the second operating mode to a third operating mode, wherein:

in the first operating mode, the central flowbore of the cementing tool is open;

in the second operating mode, a ball is landed on the first seat, at least a portion of the central flowbore is closed, and the one or more ports are open; and in the third operating mode, the ball is released from the first seat, a ball, dart, or plug is landed on the second seat, and the shifting sleeve forms an internal flow path that circumvents the second seat.

8. The liner installation work string of claim 7, wherein the liner hanger setting tool comprises a third seat configured to receive a ball landed thereon to set the liner hanger.

9. The liner installation work string of claim 8, wherein:

the first seat is configured to receive a ball having a first outer diameter thereon;

the second seat is configured to receive a ball, dart, or plug having a second outer diameter thereon, the second outer diameter being greater than the first outer diameter; and the third seat is configured to receive a ball having a diameter equal to or less than the first outer diameter thereon.

10. The liner installation work string of claim 7, further comprising an actuator coupled to the first seat, wherein the first seat is configured to release the ball therefrom upon actuation of the first seat by the actuator.

11. The liner installation work string of claim 7, wherein the first seat comprises a rotatable ball having two different sized flow paths formed therethrough, wherein the rotatable ball is rotatable between a first position in which a first flow path is aligned with the central flowbore and a second position in which a second flow path is aligned with the central flowbore.

12. The liner installation work string of claim 7, wherein the second seat is located axially above the first seat.

13. The liner installation work string of claim 12, wherein the one or more ports are located at an axial position between the first seat and the second seat.

14. A liner installation method, comprising:

providing a cementing tool coupled to a liner hanger setting tool, wherein the cementing tool comprises:

a body;

one or more ports extending through the body;

a first seat internal to the body and configured to receive a ball landed thereon;

a second seat internal to the body and configured to receive a ball, dart, or plug landed thereon; and a shifting sleeve assembly internal to the body and configured to selectively transition the cementing tool from a first operating mode to a second operating mode and from the second operating mode to a third operating mode, wherein:

in the first operating mode, a central flowbore of the cementing tool is open;

in the second operating mode, a ball is landed on the first seat, at least a portion of the central flowbore is closed, and the one or more ports are open; and in the third operating mode, the ball is released from the first seat, a ball, dart, or plug is landed on the second seat, and the shifting sleeve forms an internal flow path that circumvents the second seat;

cementing a liner coupled to the liner hanger setting tool in a wellbore via the cementing tool; and setting a liner hanger holding the liner via the liner hanger setting tool.

15. The liner installation method of claim 14, further comprising:

while the cementing tool is in the first operating mode, circulating cement through the central flowbore, the liner hanger setting tool, and the liner to cement the liner in the wellbore from bottom-up;

shifting the cementing tool from the first operating mode to the second operating mode;

while the cementing tool is in the second operating mode, routing cement through the one or more ports into an annulus surrounding the cementing tool to cement the liner in the wellbore from top-down;

shifting the cementing tool from the second operating mode to the third operating mode to reestablish flow into a flowbore of the liner hanger setting tool; and while the cementing tool is in the third operating mode, setting the liner hanger.

16. The liner installation method of claim 15, wherein:

shifting the cementing tool from the first operating mode to the second operating mode comprises landing the ball on the first seat;

shifting the cementing tool from the second operating mode to the third operating mode comprises landing the ball, dart, or plug on the second seat and releasing the ball from the first seat; and setting the liner hanger comprises landing the ball released from the first seat onto a third seat in the liner hanger setting tool.

17. The liner installation method of claim 15, further comprising cementing the liner in the wellbore from top-down before the cement circulated through the liner to cement the liner from bottom-up is dry.

18. The liner installation method of claim 14, further comprising:

while the cementing tool is in the first operating mode, circulating cement through the central flowbore, the liner hanger setting tool, and the liner to cement the liner in the wellbore from bottom-up; and while the cementing tool is in the first operating mode, and without shifting the cementing tool into the second or third operating modes, setting the liner hanger.

19. The liner installation method of claim 18, wherein setting the liner hanger comprises landing a ball on a third seat in the liner hanger setting tool.

* * * * *